US011758951B2

(12) United States Patent
Larkin

(10) Patent No.: US 11,758,951 B2
(45) **Date of Patent: *Sep. 19, 2023**

(54) SHAPING GARMENTS WITH UPPER LEG SLIMMING BANDS

(71) Applicant: HONEYLOVE SCULPTWEAR, INC., San Francisco, CA (US)

(72) Inventor: Elizabeth Anne Larkin, San Francisco, CA (US)

(73) Assignee: HONEYLOVE SCULPTWEAR, INC., Los Angeles, CA (US)

( * ) Notice: Subject to any disclaimer, the term of this patent is extended or adjusted under 35 U.S.C. 154(b) by 91 days.

This patent is subject to a terminal disclaimer.

(21) Appl. No.: 17/237,915

(22) Filed: Apr. 22, 2021

(65) Prior Publication Data

US 2021/0235774 A1 Aug. 5, 2021

Related U.S. Application Data

(63) Continuation of application No. 16/029,670, filed on Jul. 9, 2018.

(60) Provisional application No. 62/533,116, filed on Jul. 16, 2017.

(51) Int. Cl.

| | |
|---|---|
| ***A41B 11/00*** | (2006.01) |
| ***A41B 9/08*** | (2006.01) |
| ***A41B 11/14*** | (2006.01) |
| ***A41C 1/00*** | (2006.01) |
| ***A41B 11/08*** | (2006.01) |
| *A41B 17/00* | (2006.01) |

(52) U.S. Cl.

CPC ..... *A41B 11/003* (2013.01); *A41B 9/08* (2013.01); *A41B 11/14* (2013.01); *A41C 1/003* (2013.01); *A41B 11/08* (2013.01); *A41B 17/00* (2013.01); *A41B 2400/38* (2013.01); *A41B 2500/20* (2013.01)

(58) Field of Classification Search

CPC ..... A41B 11/08; A41B 11/003; A41B 11/14; A41B 9/08; A41B 17/00; A41B 2400/38; A41B 2500/20; A41C 1/003

USPC ..... 450/94, 96–98, 101

See application file for complete search history.

(56) References Cited

U.S. PATENT DOCUMENTS

| | | | | |
|---|---|---|---|---|
| 3,431,913 | A | 3/1969 | Bugnon et al. | |
| 3,748,870 | A | 7/1973 | Fregeolle | |
| 3,877,439 | A | 4/1975 | Locascio | |
| 4,390,999 | A | 7/1983 | Lawson et al. | |
| 5,201,074 | A | 4/1993 | Dicker | |
| 6,430,752 | B1 | 8/2002 | Bay | |
| 7,143,453 | B2 | 12/2006 | Duran | |
| 7,260,961 | B1 * | 8/2007 | Kennedy | D04B 1/243 66/171 |

(Continued)

OTHER PUBLICATIONS

Freddy, "Freddy the art of movement," (https://freddystore.com/), (Accessed Jul. 26, 2018).

(Continued)

*Primary Examiner* — Gloria M Hale

(74) *Attorney, Agent, or Firm* — Fenwick & West LLP

(57) ABSTRACT

Shaping garments including one or more slimming elastic bands are disclosed. In some embodiments, shaping garments include a first horizontal elastic band and a second diagonal elastic band positioned to reshape the inner and outer upper legs creating a slimmer appearance, while also lifting the buttocks.

20 Claims, 7 Drawing Sheets

(56) References Cited

U.S. PATENT DOCUMENTS

| | | | | |
|---|---|---|---|---|
| 8,214,926 | B2 | 7/2012 | Brown | |
| 8,533,864 | B1 * | 9/2013 | Kostrzewski ..... | A41D 13/0015 2/69 |
| 8,647,168 | B2 | 2/2014 | Anvaripour | |
| 9,320,306 | B2 | 4/2016 | Freddi et al. | |
| 9,895,569 | B2 * | 2/2018 | Yao ..... | A63B 21/4007 |
| D817,600 | S | 5/2018 | Brown | |
| 2002/0007507 | A1 | 1/2002 | Duran | |
| 2007/0067892 | A1 | 3/2007 | Oyama et al. | |
| 2010/0130903 | A1 * | 5/2010 | Rock ..... | D04B 1/243 602/62 |
| 2011/0214216 | A1 | 9/2011 | Zarabi | |
| 2012/0156962 | A1 | 6/2012 | Krawchuk | |
| 2013/0316617 | A1 | 11/2013 | Freddi et al. | |
| 2014/0310854 | A1 | 10/2014 | Kianmahd | |
| 2017/0172219 | A1 | 6/2017 | Liao et al. | |

OTHER PUBLICATIONS

United States Office Action, U.S. Appl. No. 16/029,670, dated Oct. 1, 2020, 12 pages.
United States Office Action, U.S. Appl. No. 16/029,670, dated Mar. 27, 2020, seven pages.

* cited by examiner

SHAPING GARMENTS WITH UPPER LEG SLIMMING BANDS

CROSS-REFERENCE TO RELATED APPLICATIONS

This application is a continuation of U.S. patent application Ser. No. 16/029,670, filed on Jul. 9, 2018 know issued as U.S. Pat. No. 11,013,274), which claims the benefit of U.S. Provisional Patent Application No. 62/533,116, filed on Jul. 16, 2017, which are incorporated by reference herein in their entirety.

FIELD

The present disclosure relates to shaping garments, specifically to shaping garments with upper leg slimming bands which reshape the inner and outer upper legs creating a slimmer appearance, while also lifting the buttocks.

BACKGROUND

Extra flesh in the upper legs can be difficult to lose through dieting and exercise due to genetics playing the primary role in the structure of this area of the body. Known body shaping garments smooth fat and cellulite by squeezing the body uniformly like a sock but do very little to alter the shape of the upper thighs, which is an area of concern for many people. This uniform squeezing of the legs can also result in bulges where the fabric ends at leg openings.

Some known garments may create the appearance of a more voluptuous buttocks. One known garment is stretchy shorts that encourage the buttocks to protrude through circular cut-outs to lift the bottom. Another known garment uses padding inserted into the backside for creating a larger and more round buttocks.

Lastly, some known garments for shaping the legs and bottom are designed to be worn beneath dresses and skirts, where inner thigh shape is not visible. These garments may squeeze the legs uniformly causing a bulge where the fabric ends at the leg openings.

SUMMARY

Embodiments disclosed herein are directed to shaping garments including upper leg slimming bands that sculpt upper thighs and lift the bottom by shifting extra flesh from the inner and outer upper legs toward the backs of legs, and subsequently upward toward the buttocks. In some embodiments, this sculpting effect is achieved by integrating elastic slimming bands into the back leg area of body shaping undergarments, pantyhose, leggings, or other tight-fitting garments. The bands shift extra flesh on the inner and outer upper legs towards the back of the legs. A garment wearer may then manually adjust the garment so that extra flesh in the buttocks rests above the bands, creating the appearance of a more voluptuous bottom. Shaping garments disclosed herein are well suited for wearing with leggings and pants, where the shape of the user's inner thighs is visible. By moving the flesh deliberately and gently redistributing it, disclosed shaping garments do not produce visible bulges where the fabric ends.

The disclosed shaping garments not only improve the appearance of the buttocks, but also sculpt the appearance of the upper thighs without adding any additional bulk to the user's body in the form of padding. Embodiments described in this disclosure provide for a slimmer silhouette in the upper thighs, clear definition between the backs of the legs and the buttocks, and the appearance of a higher and more voluptuous buttocks.

Some embodiments incorporate specially positioned elastic bands in the back of the upper leg area of tight fitting shorts and pants, which may include a foundation undergarment bodysuit, a mid-thigh foundation undergarment, stretch leg tubes, pantyhose, footless pantyhose, and leggings.

In some embodiments, a piece of soft elastic is laid flat diagonally on the inside of the upper back leg of the garment. The elastic is sewn flat so that it rests just under the buttocks near the outer leg seam and extends around the back of the leg diagonally downward to the inner leg seam. In some embodiments, a second piece of soft elastic is positioned horizontally over the diagonal piece of elastic so that it rests just under the buttocks extending from the outer leg seam, to the inner leg seam, just below the crotch. In some embodiments, a compression fabric panel that follows the curve of the buttocks is used in place of the diagonal elastic or horizontal elastic.

Embodiments disclosed herein provide several advantages over known shaping garments. The disclosed shaping garments with upper leg slimming bands specifically target extra flesh in the upper legs, visibly sculpting the inner and outer thighs. Previously known shaping garments may compress the leg equally around its circumference which often results in a bulge where the fabric ends at the leg opening. According to some embodiments, a double layer of elastic also serves to redistribute extra flesh, so that there are no visible bulges at the borders of fabric and elastic. According to some embodiments, a horizontal layer of elastic, which is closest to the user's leg, shifts extra flesh from inner and outer thighs. A diagonal layer of elastic may provide a second layer of compression, which gently redistributes the flesh which has been shifted from the horizontal elastic band. This may prevent bulges from arising below elastic layers and the point where the fabric ends at leg openings.

Disclosed shaping garments with elastic slimming bands do not wrap all the way around the circumference of the legs. Due to this arrangement, extra flesh on the inner side of front femur bone is pushed backward due to the tension caused by the bands being anchored in the inner and outer leg seams. Flesh on the upper outer thighs is pushed backward from the tension of the elastic slimming bands. The front leg area of the garment is not under the tension of the slimming bands because they extend around the back of the legs only. This allows for a release of tension in the front leg, creating a smooth appearance in the front leg and more comfort for the user.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Embodiments disclosed herein provide for shaping garments with upper leg slimming bands. In some embodiments, upper leg slimming bands are constructed using two layers of elastic that are strategically assembled in a way that shifts extra flesh from inner and outer upper thighs backward and upward toward the buttocks, creating a slimmer silhouette in the upper legs and a higher and more defined buttocks.

The disclosed shaping garments specifically target slimming the upper leg area—a region which has not been adequately addressed by previously known shaping garments. These previously known shaping garments do not sufficiently reduce the appearance of extra flesh in the upper leg area, which may be more visible in pants and leggings. Other garments may squeeze the body in a uniform way which causes the extra flesh to release at leg openings, creating a bulge of flesh. Embodiments discussed in further detail below reduce bulging of flesh where the fabric ends at leg openings of garments. In these embodiments, strategically placed upper leg slimming bands shift flesh and redistribute it gradually so that there is decreased bulging in these areas.

The benefits provided by the disclosed shaping garments with upper leg slimming bands include visual slimming of the upper legs, the appearance of a higher buttocks, and better definition between buttocks and legs, creating an overall slimmer and more fit appearance. Shaping garments disclosed herein may be undergarments for wearing underneath clothing. Some embodiments may be especially well suited to wear under slim fitting clothing where the inner upper leg area is visible such as leggings, tight pants, and jeans.

Figure 1A:
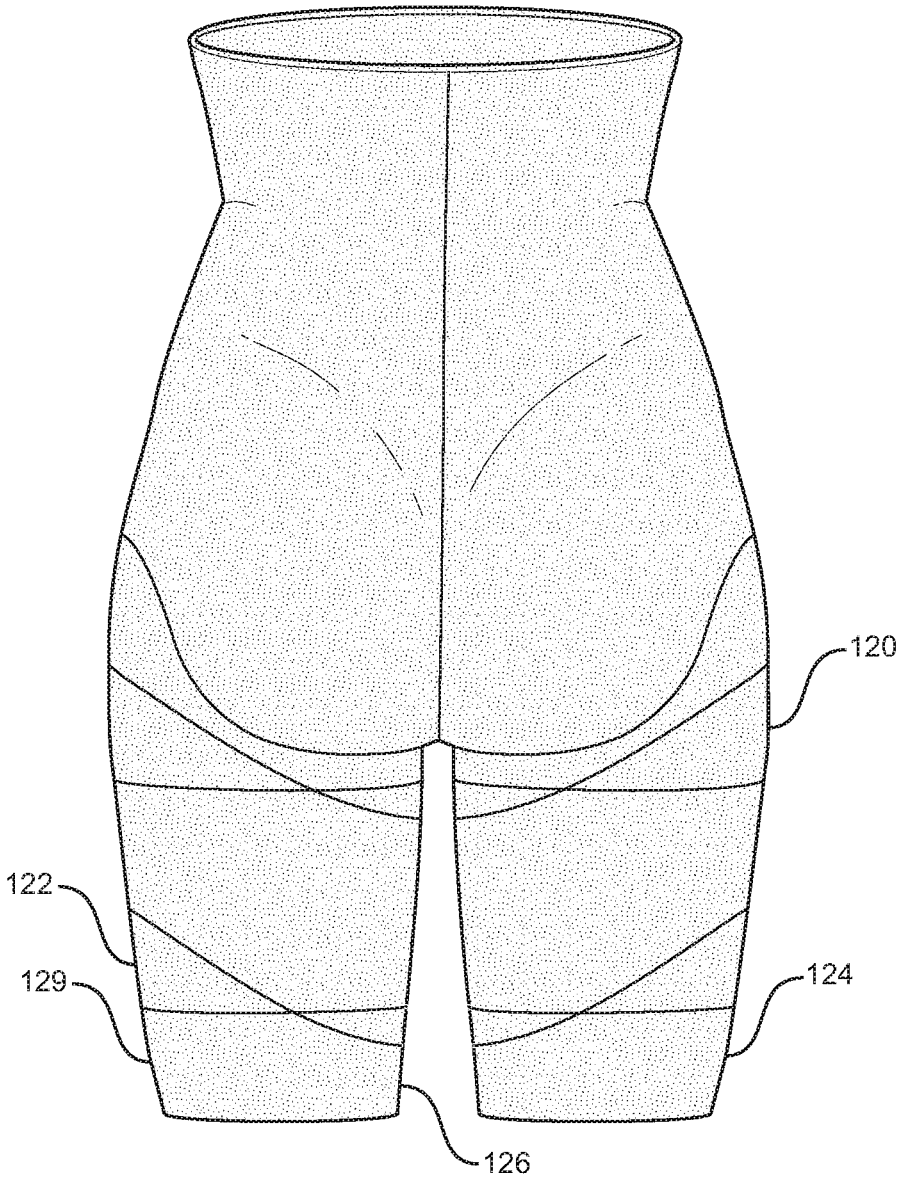
FIG. 1A illustrates a back view of a foundation undergarment with upper leg slimming bands according to an embodiment.
Figure 1B:
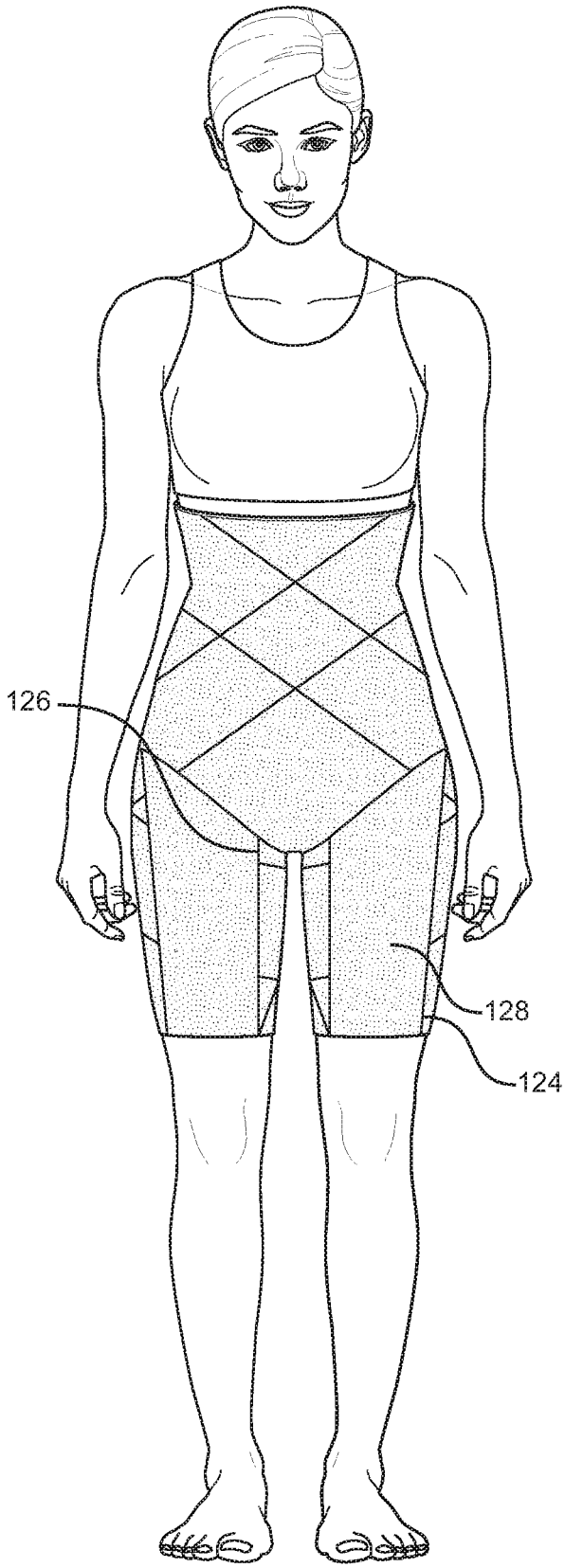
FIG. 1B illustrates a front view of a foundation undergarment with upper leg slimming bands according to an embodiment.
Figure 1C:
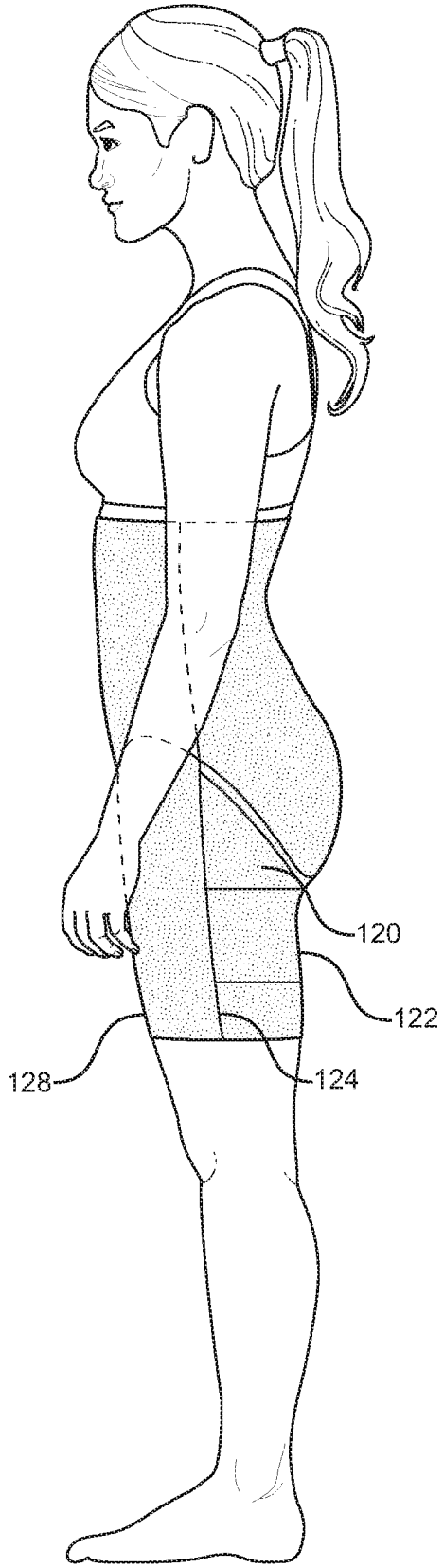
FIG. 1C illustrates a side view of a foundation undergarment with upper leg slimming bands according to an embodiment.

FIG. 1 illustrates various views of a foundation undergarment with upper leg slimming bands according to an embodiment. FIG. 1A is a back view, FIG. 1B is a front view, and FIG. 1C is a side view of the foundation undergarment.

FIG. 1A illustrates a back view of a foundation undergarment with upper leg slimming bands according to an embodiment. The foundation undergarment illustrated in FIG. 1 provides for a large slimmed and shaped area on the inner and outer upper thighs, while also supporting the natural shape of the user's buttocks. Diagonal elastic band 120 supports the area of the buttocks closer to the outer hip, and horizontal elastic band 122 supports and lifts the shape of the user's buttocks closer to the center of the body. The two elastic bands 120 and 122 combined provide a balanced lift of the buttocks. Diagonal elastic band 120 is positioned on the inside of the back leg portion 129 of the garment, extending diagonally from below the top of the outer leg seam portion 124 downward across the back of the leg of the garment to the inner leg seam portion 126.

FIG. 1B illustrates a front view of a foundation undergarment with upper leg slimming bands according to an embodiment. In FIG. 1B, slimming bands are integrated into the back legs of the garment, extending horizontally from the outer leg seam portion 124 along the back of the leg to the inner leg seam portion 126. In this arrangement, front leg portion 128 of the garment is not under the tension of the elastic slimming bands because they extend around the back of the legs only. This allows for a release of tension in the front leg, creating a smooth appearance in the front leg and more comfort for the user. In some embodiments, the side seams are positioned slightly closer to the front of the femur bone, rather than directly centered on the inner and outer thighs. This allows the upper slimming bands to shift more of the flesh away from the inner and outer thighs.

FIG. 1C illustrates a side view of a foundation undergarment with upper leg slimming bands according to an embodiment. Here, elastic bands 120 and 122 are positioned to provide a slimmed and shaped area on the inner and outer upper thighs, while also supporting the natural shape of the user's buttocks. Horizontal elastic band 122 is positioned flat on the inside of the back leg of the garment closest to the skin, extending horizontally from the outer leg seam portion 124 over the back leg to the inner leg. Diagonal elastic band 120 is positioned behind horizontal elastic band 122, extending diagonally from below the top of the outer leg seam 124 downward across the back of the leg to the inner leg. As illustrated, front leg portion 128 of the garment is not under the tension of the elastic slimming bands because they extend around the back of the legs only. In this arrangement, flesh on the upper outer thighs is pushed backward from the tension of elastic bands 120 and 122.

Figures 2A, 2B, 2C:
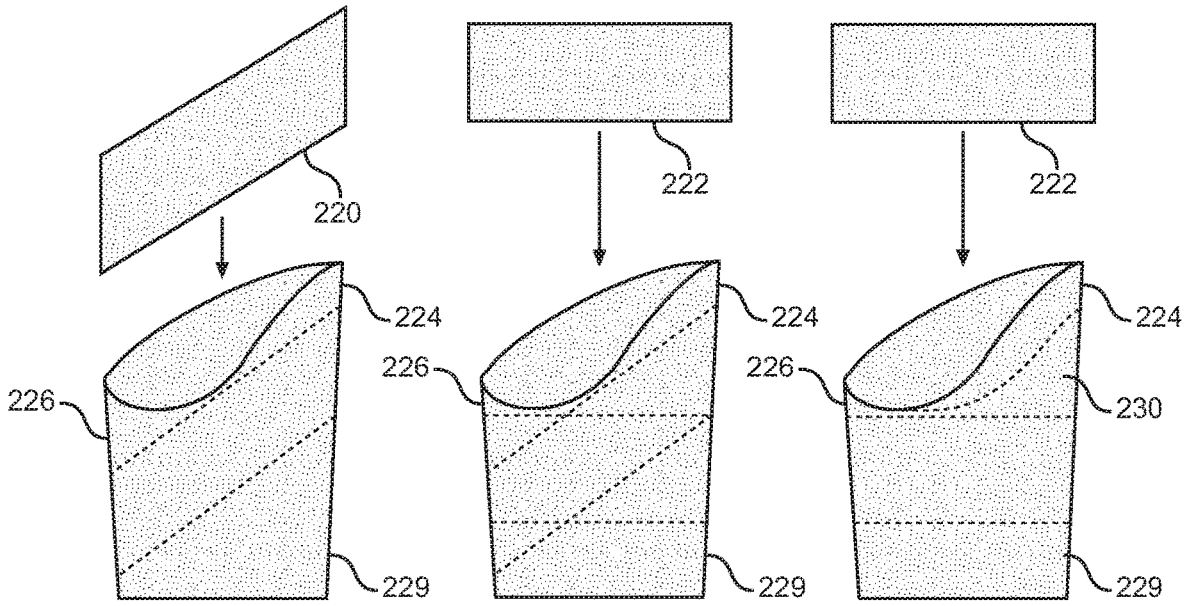
FIG. 2A illustrates a portion of a shaping garment with a diagonal elastic band according to an embodiment.
FIG. 2B illustrates a portion of a shaping garment with a horizontal elastic band according to an embodiment.
FIG. 2C illustrates a portion of a shaping garment with a compression fabric panel according to an embodiment.

FIG. 2 illustrates an example of a shaping garment with a diagonal elastic band according to an embodiment. FIG. 2A shows a diagonal elastic band 220 integrated into a shaping garment. Diagonal elastic band 220 may be a soft elastic band between approximately three to four inches in width. As illustrated in FIG. 2A, diagonal elastic band 220 is positioned and sewn to the inside of the back leg portion 229 of the garment, extending diagonally from below the top of the outer leg seam portion 224 downward across the back of the leg of the garment to the inner leg seam portion 226. In some embodiments, diagonal elastic band 220 is attached to the shaping garment with an edge-stitch along the longer edges to the inner (i.e., skin-facing) side of the shaping garment. In some embodiments, the diagonal elastic band 220 is positioned flat against the back leg of the garment and dimensioned so as to not extend above the back leg fabric into the bottom area of the garment.

FIG. 2B shows a horizontal elastic band 222 integrated into a shaping garment. In FIG. 2B, the shaping garment may be a shaping garment such as that illustrated in FIG. 2A, with a horizontal elastic band. In an embodiment, horizontal elastic band 222 may be a soft elastic band between approximately three to four inches. As illustrated in FIG. 2B, horizontal elastic band 222 is positioned flat extending horizontally from the outer leg seam portion 224 to the inner leg seam portion 226. In the example shaping garment illustrated in FIG. 2B, the top of horizontal elastic band 222 rests approximately ¼ inch to ½ inch below the bottom when the shaping garment is on the user's body. In some embodiments, the top and bottom of horizontal elastic band 222 are edge-stitched to the shaping garment so that horizontal elastic band 222 is affixed flat over the diagonal elastic on the inner (i.e., skin-facing) side of the shaping garment.

FIG. 2C shows a horizontal elastic band 222 integrated into a shaping garment. In FIG. 2C, the shaping garment may be a shaping garment such as that illustrated in FIG. 2B, but with a compression fabric panel 230 in place of a diagonal elastic band. The compression fabric panel 230 may be cut in a specific shape that follows the curve of the buttocks. Compression fabric panel 230 serves a similar function as the diagonal elastic band of FIG. 2B and is incorporated, such as by sewing, into the back leg portion of the garment in a way that follows the curve of the user's bottom. The compression fabric panel 230 may be smoother under clothing and more form-fitting than a diagonal elastic band because it covers a wider area and has a more natural circular or curved outline compared to the straight lines of an elastic band. Horizontal elastic band 222 is positioned flat extending horizontally from the outer leg seam portion 224 to the inner leg seam portion 226 across the compression fabric panel 230, such that the horizontal elastic band 222 is on the inner (i.e., skin-facing) side of the garment. In general, any elastic band described in any embodiment in this disclosure may be replaced with a similar compression fabric panel to serve a similar function. Aspects of other embodiments in this disclosure may be applied equally to the embodiment in FIG. 2C.

Figure 3:
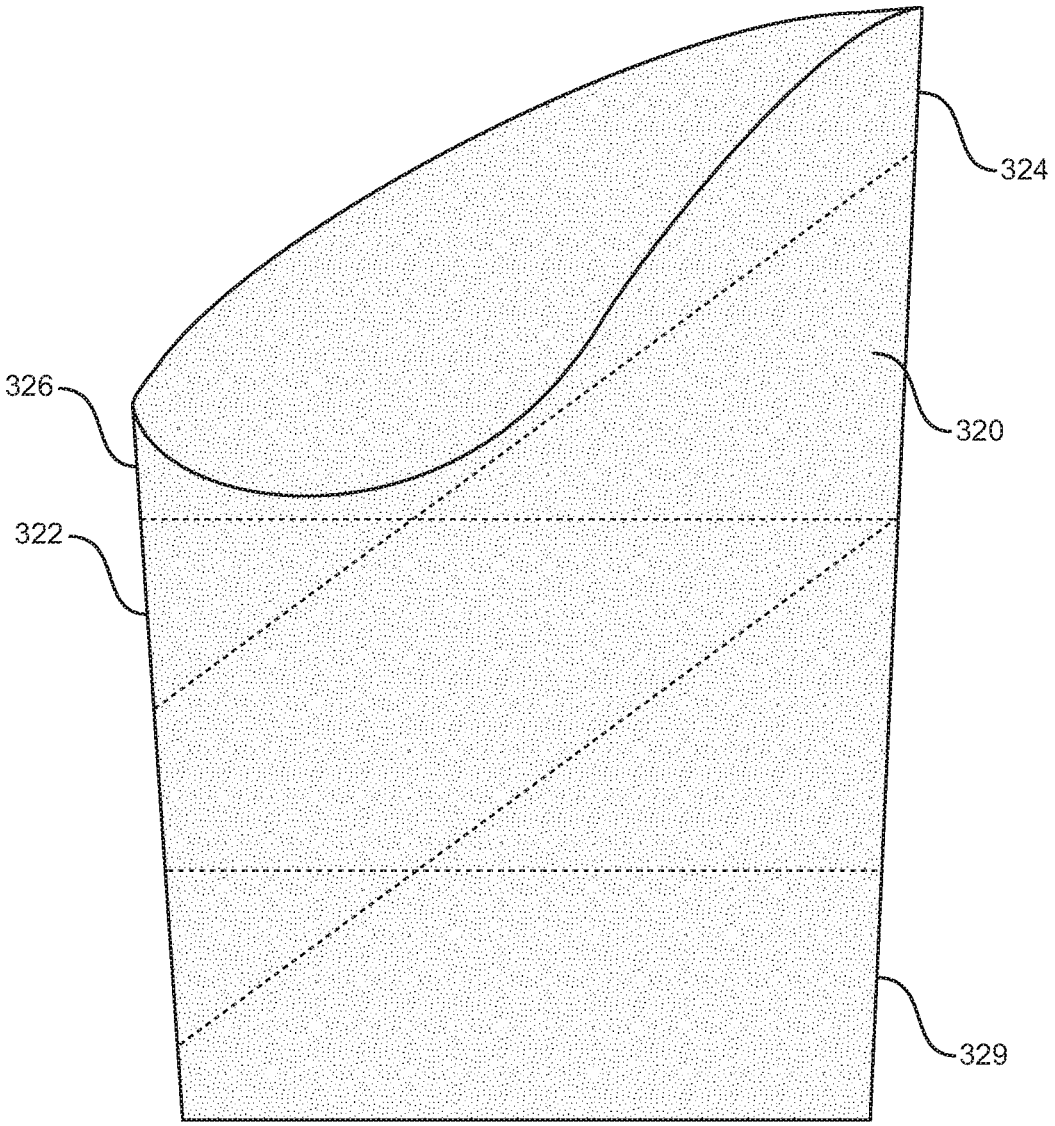
FIG. 3 illustrates an inside-out view of the leg of a foundation undergarment with upper leg slimming bands according to an embodiment.

FIG. 3 illustrates an example of a shaping garment with a diagonal elastic band and a horizontal elastic band according to an embodiment. FIG. 3 provides a close-up view of the inside-out leg of a shaping garment with upper leg slimming bands integrated. Diagonal elastic band 320 is sewn into the inside back leg of a garment starting at a point roughly two inches from the top of the outer leg seam 324 around the back of the leg to the inseam. Horizontal elastic band 322 is sewn into the inseam 326 at a point beginning approximately ¼ inch to ½ inch below the top of the garment's inseam, around the back of the leg, where it is then sewn into the outer leg seam. Elastic bands 320 and 322 may be anchored into side seams using a serger or overlock sewing machine. The bands may also be edge-stitched along the top and bottom. In some embodiments, the elastic is sewn flat to the back leg of the garment to prevent any rippling in the fabric.

The upper leg slimming bands are comprised of two layers of elastic, one that runs diagonally and one that runs horizontally around the back of the leg between inner and outer side seams. The horizontal elastic band 322 rests directly against the skin. The diagonal elastic band 320 engages the extra flesh which arises at the edges of the horizontal elastic band 322 and redistributes it so that there is no visible bulging at the borders of the elastic bands. In some embodiments, the order of the elastic bands may be reversed such that the diagonal elastic rests closest to the skin and the horizontal elastic is behind the diagonal elastic.

Figure 4:
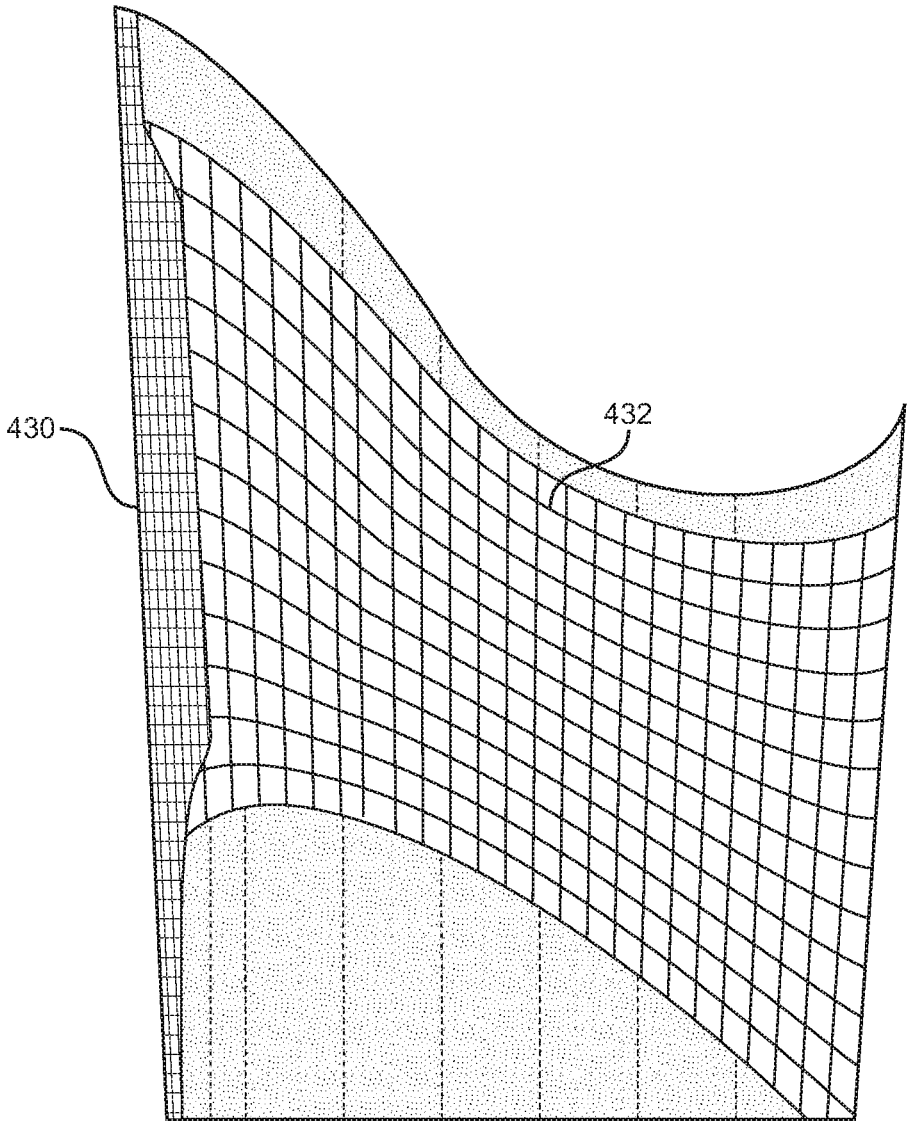
FIG. 4 illustrates a shaping garment with upper leg slimming bands integrated into the weave of the fabric of the garment.

FIG. 4 illustrates a shaping garment with upper leg slimming bands integrated into the weave of the fabric of the garment. In an embodiment, the integrated upper leg sliming bands may be constructed using a gradual weaving method. In this embodiment, upper leg slimming bands are woven directly into the back leg of the garment using gradually increasing layers of elastic thread. In the upper area of legs which are often more fleshy, a thicker weave portion 430 provides additional support. A thinner weave portion 432 of elastic thread is used near the bottom leg area of the garment.

A shaping garment with upper leg slimming bands constructed using a gradual weave such as illustrated in FIG. 4 may provide for a more seamless look under clothing. Because the elastic weave is progressively transitioned from thicker to thinner, the flesh is compressed with sufficient strength while being absorbed and redistributed gradually due to the gradual weave transition from the thicker elastic center to the thinner edges. The elastic weave gradually transitions from thicker to thinner weave along the garment from the upper leg area to the bottom leg area. This gradual weave provides for greater compression in the fleshiest part of the leg and gradually lower compression towards the lower leg area of the garment so that there is no bulging at the place where the fabric ends at the leg openings.

While illustrated in the context of one type of shaping garment in FIG. 4, any embodiment of shaping garment may use the gradual weave described here. For example, upper leg slimming bands constructed using a gradual weaving method may be integrated into foundation undergarment bodysuits, mid-thigh foundation undergarments, compression leg tubes, pantyhose, footless pantyhose, and leggings, among others.

FIG. 5 illustrates various examples of shaping garments with integrated upper leg slimming bands. Each illustrated example embodiment shows the positions of a diagonal elastic band 520 and a horizontal elastic band 522 relative to a front leg portion 528 and/or a back leg portion 529 of various garment styles. In each example, diagonal elastic band 520 and horizontal elastic band 522 may be either discrete elastic bands attached to the garment or elastic thread woven into the garment such as discussed in relation to FIG. 4.

Figure 5A:
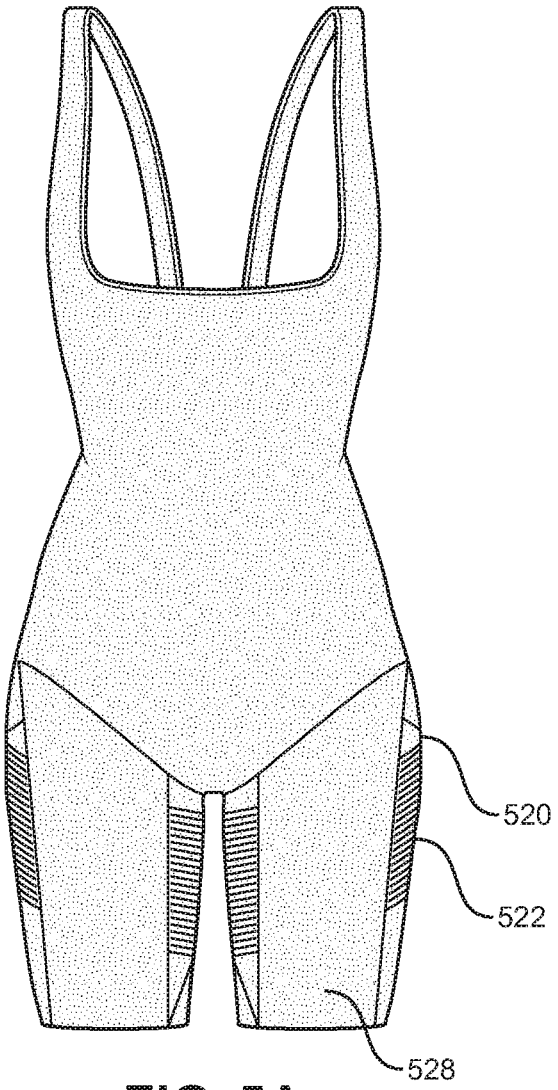
FIG. 5A illustrates a foundation undergarment bodysuit with upper leg slimming bands according to an embodiment.
Figure 5B:
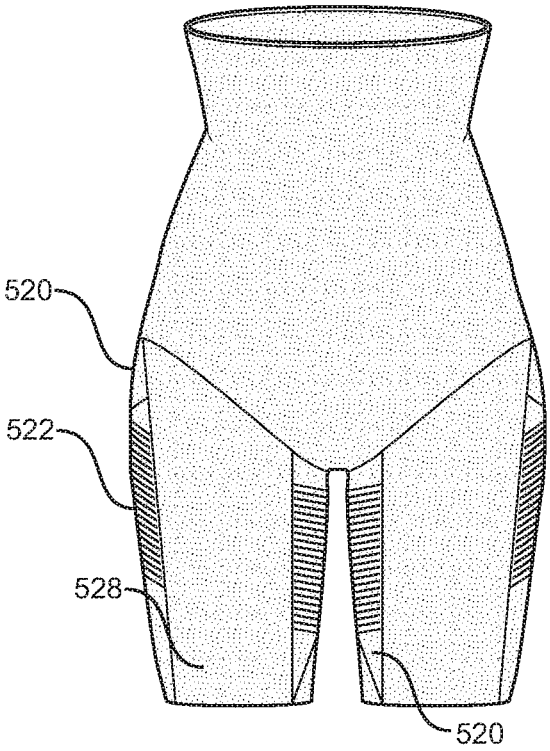
FIG. 5B illustrates a mid-thigh foundation undergarment with upper leg slimming bands according to an embodiment.
Figure 5C:
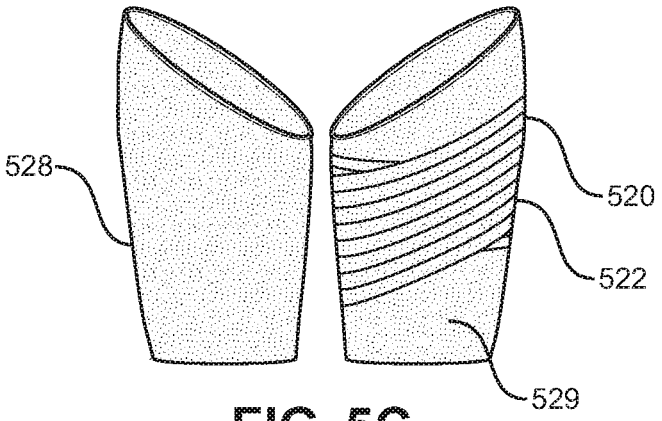
FIG. 5C illustrates compression leg tubes with upper leg slimming bands according to an embodiment.
Figure 5D:
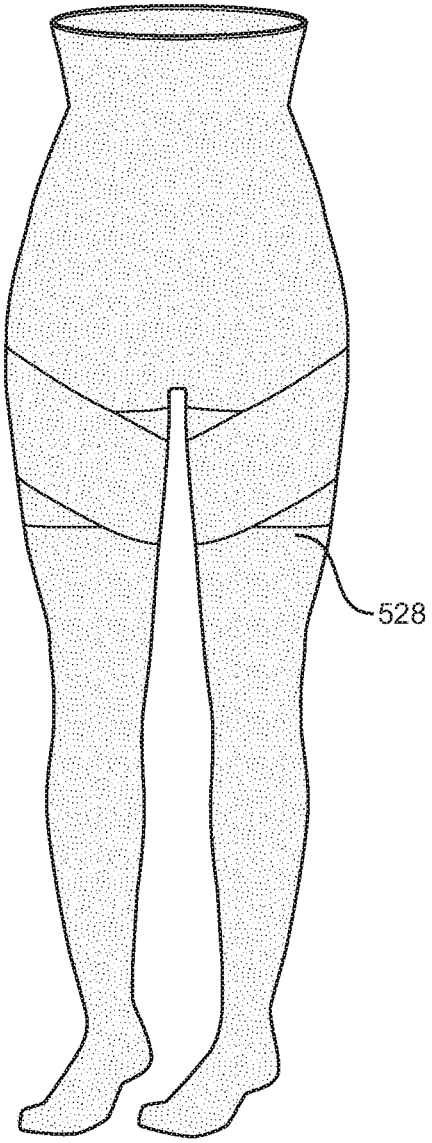
FIG. 5D illustrates pantyhose with upper leg slimming bands according to an embodiment.
Figure 5E:
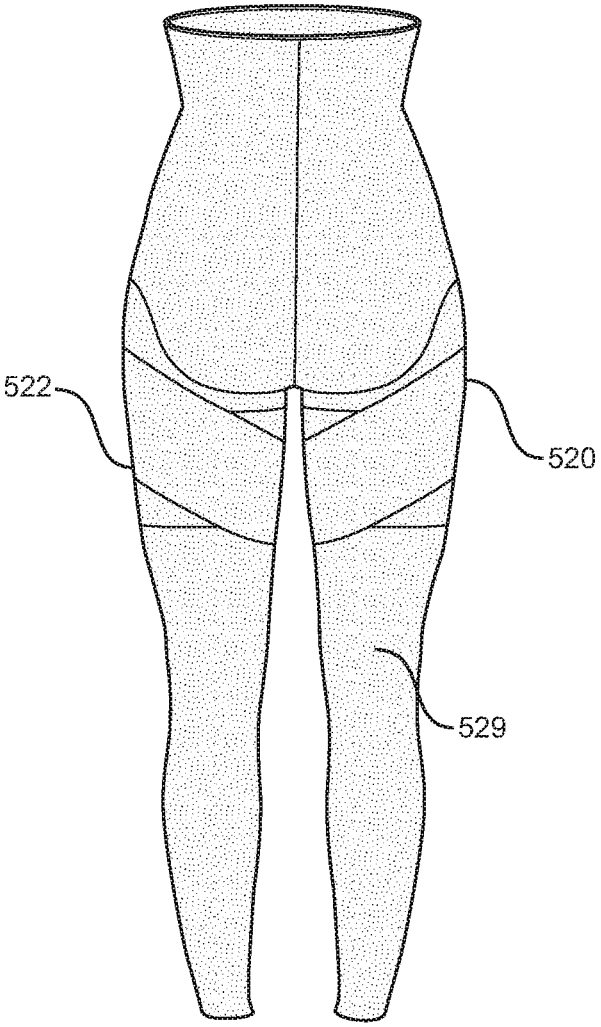
FIG. 5E illustrates footless pantyhose and leggings with upper leg slimming bands according to an embodiment.

FIG. 5A illustrates a foundation undergarment bodysuit with upper leg slimming bands according to an embodiment. FIG. 5B illustrates a mid-thigh foundation undergarment with upper leg slimming bands according to an embodiment. FIG. 5C illustrates compression leg tubes with upper leg slimming bands according to an embodiment. FIG. 5D illustrates pantyhose with upper leg slimming bands according to an embodiment. FIG. 5E illustrates footless pantyhose and leggings with upper leg slimming bands according to an embodiment. In each of these examples, upper leg slimming bands sculpt upper thighs and lift the bottom by shifting extra flesh from the inner and outer upper legs toward the backs of legs, and subsequently upward toward the buttocks, creating the appearance of a more voluptuous bottom.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims.

What is claimed is:

1. An undergarment, comprising:

a front area;

a buttock area opposite the front area;

a front leg portion attached to the front area; and a back leg portion attached to the buttock area, the back leg portion having a top end and a bottom end, the back leg portion attached to the front leg portion along an inner leg seam and an outer leg seam, wherein the back leg portion comprises a first section and a second section, the first section comprising a first elastic weave toward the top end of the back leg portion, and the second section of the back leg portion comprising a second elastic weave toward the bottom end of the back leg portion, the first elastic weave having more layers of elastic thread than the second elastic weave.

2. The undergarment of claim 1, wherein the first elastic weave gradually transitions to the second elastic weave.

3. The undergarment of claim 1, wherein the first elastic weave and the second elastic weave are configured to provide a greater compression toward the top end of the back leg portion and to provide a gradually lower compression towards the bottom end of the back leg portion.

4. The undergarment of claim 1, wherein the first elastic weave and the second elastic weave form a diagonal elastic band that is positioned at the back leg portion of the undergarment and extends diagonally from the outer leg seam to the inner leg seam.

5. The undergarment of claim 4, wherein the diagonal elastic band is approximately 3 to 4 inches in width.

6. The undergarment of claim 4, wherein the diagonal elastic band is attached to the outer leg seam approximately between 1 to 3 inches below a top end of the outer leg seam.

7. The undergarment of claim 1, wherein the first elastic weave and the second elastic weave form a horizontal elastic band that is positioned at the back leg portion of the undergarment and extends from the inner leg seam to the outer leg seam.

8. The undergarment of claim 7, wherein the horizontal elastic band is approximately 3 to 4 inches in width.

9. The undergarment of claim 7, wherein a top of the horizontal elastic band is positioned to rest approximately ¼ to ½ inch below buttocks of a user when the undergarment is worn by the user.

10. The undergarment of claim 1, wherein the back leg portion provides substantially more compression compared to the front leg portion.

11. An undergarment, comprising:

a front area;

a buttock area opposite the front area;

a front leg portion attached to the front area;

a back leg portion attached to the buttock area, the back leg portion attached to the front leg portion along an inner leg seam and an outer leg seam; and a compression fabric panel positioned at the back leg portion of the undergarment, the compression fabric panel providing substantially more compression at the back leg portion compared to the front leg portion.

12. The undergarment of claim 11, further comprising a horizontal elastic band positioned at the back leg portion of the undergarment, the horizontal elastic band extending from the inner leg seam to the outer leg seam.

13. The undergarment of claim 12, wherein a top of the horizontal elastic band is positioned to rest approximately ¼ to ½ inch below buttocks of a user when the undergarment is worn by the user.

14. The sculpting undergarment of claim 12, wherein the horizontal elastic band is approximately 3 to 4 inches in width.

15. The sculpting undergarment of claim 12, wherein the horizontal elastic band is positioned in the sculpting undergarment such that when a user wears the sculpting undergarment, the horizontal elastic band rests on a thigh of the user.

16. The sculpting undergarment of claim 15, wherein the compression fabric panel is positioned relative to the horizontal elastic band such that the compression fabric panel engages a part of the flesh shifted by the horizontal elastic band and redistributes a part of the flesh.

17. The sculpting undergarment of claim 12, wherein the horizontal elastic band is located on the inner side of the undergarment, and at least a portion of the compression fabric panel overlaps the horizontal elastic band.

18. The sculpting undergarment of claim 12, wherein the horizontal elastic band extends across the compression fabric panel.

19. The sculpting undergarment of claim 11, wherein the compression fabric panel is sewn into the back leg portion.

20. The sculpting undergarment of claim 11, wherein the compression fabric panel comprises a top edge having a shape that follows a curve of buttocks of a user.

* * * * *